United States Patent [19]

Jonville

[11] 4,086,155

[45] Apr. 25, 1978

[54] ELECTROLYZER WITH RELEASED GAS

[75] Inventor: Pierre Jonville, Plan-les-Ouates, Switzerland

[73] Assignee: Battelle Memorial Institute, Geneva, Switzerland

[21] Appl. No.: 678,745

[22] Filed: Apr. 21, 1976

[30] Foreign Application Priority Data

Apr. 25, 1975 Switzerland ..... 5365/75

[51] Int. Cl.[2] ..... C25B 1/16; C25B 1/26; C25B 11/03; C25B 11/10

[52] U.S. Cl. ..... 204/266; 204/252; 204/270; 204/278; 204/284; 204/290 R

[58] Field of Search ..... 204/252, 265, 266, 270, 204/277, 278, 284, 290 R, 290 F

[56] References Cited

U.S. PATENT DOCUMENTS

| | | | |
|---|---|---|---|
| 3,284,243 | 11/1966 | Von Sturm | 429/40 |
| 3,410,783 | 11/1968 | Tomter | 204/266 |
| 3,485,744 | 12/1969 | Schaffner | 204/290 R |
| 3,607,687 | 9/1971 | Grangaard | 204/277 X |
| 3,763,005 | 10/1973 | Butre et al. | 204/128 X |
| 3,778,307 | 12/1973 | Beer et al. | 204/290 F X |
| 3,926,769 | 12/1975 | Gritzner | 204/266 X |
| 3,975,557 | 8/1976 | Kuchek | 204/290 R X |
| 4,005,004 | 1/1977 | Seko et al. | 204/290 R X |

*Primary Examiner*—Arthur C. Prescott
*Attorney, Agent, or Firm*—Haseltine, Lake & Waters

[57] ABSTRACT

An electrolyzer comprising a cathode and an anode, disposed in an aqueous electrolyte bath, the electrodes each having at least one active surface directed substantially in facing relation to at least one active surface of the electrode of opposite polarity. At least one of the electrodes is permeable to gas and is the source of a gas release at the time of operation of the electrolyzer. At least one portion of the active surface of the electrode permeable to the gas is covered by a porous layer constituted by at least one refractory oxide which is electrically insulative and chemically inert with regard to the electrolyte and to the products formed at the time of electrolysis. The layer has a homogeneous distribution of pore sizes of a value sufficient for the electrolyte to traverse this layer and impregnate the electrode, the mean value of the radii of the pores of the insulating refractory oxide layer being at least as small as one-tenth of that of the pores of the electrode that it covers. The electrode and the oxide layer form an element of self-supporting structure, the oxide layer constituting a surface portion in contact with the electrolyte.

7 Claims, 5 Drawing Figures

ELECTROLYZER WITH RELEASED GAS

FIELD OF THE INVENTION

The invention relates to an electrolyzer in which gas is released, the electrolyzer comprising at least one cathode and at least one anode disposed in an aqueous electrolyte bath, the electrodes each having at least one active surface directed substantially in facing relation with at least one active surface of an electrode of opposite polarity, at least one of the electrodes being permeable to gas and being the source of a release of gas at the time of operation of the electrolyzer.

BACKGROUND OF THE INVENTION

Electrolyzers of this type are known. For example, one electrolyzer, adapted to effect the electrolysis of water, comprises at least one porous cathode, and at least one porous anode which can be of a noble metal, for example platinum, these electrodes being immersed in a suitable aqueous bath of electrolyte such as a dilute solution of a strong mineral acid. At the time of operation of this electrolyzer, hydrogen is released at the interface between the electrolyte and the cathode, that is to say, at the surface of the cathode in contact with the electrolyte, in the form of gas bubbles. Additionally, and simultaneously, oxygen is released in the form of bubbles at the interface between the electrolyte and the anode.

Another known electrolyzer, adapted for the production of chlorine and the manufacture of sodium, by electrolysis of an aqueous solution of sodium chloride, comprises at least one porous cathode of a metal such as nickel or iron, and at least one porous anode which can be a metal such as titanium, or graphite. These electrodes are immersed in the electrolyte and anodic and cathodic compartments are separated by a porous diaphragm which can be of asbestos or porcelain or a suitable metal. At the time of operation of this electrolyzer, there is produced a release of bubbles of hydrogen at the cathode-electrolyte interface and bubbles of chlorine at the anode-electrolyte interface.

The gas release discussed hereinabove, is produced in major portion at the active surfaces of the electrode which are facing the electrodes of opposite polarity, that is to say along lines of electrolysis current. There results therefrom an interruption of a portion of the latter for each release of gas bubbles which produces a polarization of the electrodes and diminishes the electrochemical yield of the electrolysis.

Swiss Pat. No. 480,870 describes an electrode with gas diffusion adapted to be utilized in an electrolyzer of the same type as that which is the object of the present invention.

This electrode is composed of a porous layer of electrochemically active material (designated a "work layer"), a layer of porous material electrochemically inactive serving the function of a mechanical support for the electrode and an intermediate layer of electrically insulative, porous material, interposed between the "work layer" and the "support layer", the mean value of the pore size of this intermediate layer being less than that of the pore size of the "work layer".

Although this electrode avoids the release of gas in the electrolyte just discussed, it presents nevertheless the disadvantage of being the source of a substantial voltage drop, being able to reach 10% of the theoretical voltage of the electrolyzer, which is caused by the presence of the support layer.

In addition, in the case where the "support layer" is of an electrically conductive material, for example, a metal, the current density in the electrolyzer is limited to a value such that the resistance drop which appears between the two faces of the "support layer" would be less than the electrolysis voltage of the electrolyte (for example, in the case where this latter is an aqueous electrolyte, this resistance drop must not be less than about 1.23 volts). In fact, for a resistance drop at least equal to the electrolysis voltage of the electrolyte, the conductive support layer would be composed at least partially of a bipolar electrode and would be the source of undesirable parasitic release of gas.

Additionally, the utilization of an electrically conductive "support layer" introduces the risk of a short circuit with the active electrode which requires the electrical isolation of these two members in order to avoid the gaseous release from the "support layer". For analogous reasons, a metallic "support layer" must be electrically insulated from the counter electrode of the electrolyzer which it faces. This makes necessary the disposition between the two electrodes, facing one another in the electrolyzer, of electrical insulation means such as a separator. The presence of such separator leads to a resistance drop and additonal encumbrance.

Finally the volume occupied by the "support layer" increases the total volume of the electrolyzer without increase of its power.

SUMMARY OF THE INVENTION

An object of the invention is to provide an electrolyzer which obviates the disadvantages which have just been mentioned.

In this regard, the electrolyzer according to the invention, in which at least one portion of the said active surface of one electrode permeable to gas is covered by a porous layer constituted by at least one electrically insulative refractory oxide inert chemically with regard to the electrolyte and the products formed at the time of electrolysis, at least in the range of normal operating. temperature of the electrolyzer, this layer having a homogeneous distribution of its pores, these latter having, in addition, an absolute value sufficient for the electrolyte to traverse this layer and impregnate the said electrode, is characterized by the fact that the mean value of the pore size of the said insulative refractory oxide layer is smaller than at least one-tenth of that of the pores of the electrode which it coats and by the fact that the said electrode and the said oxide layer form an element of self-sustaining structure, this latter layer of which constitutes a surface portion in contact with the electrolyte.

One can utilize as the refractory oxide, for example, zirconium oxide $ZRO_2$, magnesium oxide MGO, aluminum oxide $Al_2O_3$, thorium oxide $ThO_2$, titanium oxide $TiO_2$ or a mixture or solid solution of at least two of these oxides. One can also utilize an oxide compound consisting of a defined compound formed from at least two of these oxides or even a mixture of at least one such definite compound with at least one solid solution of at least two of the preceding oxides and/or with at least one of these oxides. In general manner, one can use any crystallized and/or vitreous composition having a base of at least one refractory mineral oxide.

Experience has shown that one can form a porous and refractory oxide layer particularly advantageously, in view of the invention, by forming one such layer directly on the surface of the electrode by projection of an oxide powder or of materials capable of leading to one such oxide by means of a plasma beam (or torch).

One can also form the porous layer of refractory oxide by any other suitable method, for example, by deposit from a vapor phase (notably by chemical reaction in vapor phase "C.V.D" by evaporation-condensation under reduced pressure, etc . . . ) As regards the pore size of the porous layer of refractory oxide and the distribution of the sizes of thse pores, the characteristics of this layer must be the following:

Distribution of the diameters of the pores: as uniform as possible both with respect to the geometric distribution and the dispersion of the values of these diameters. It is sufficient however that the ratio between the diameter of the largest pores and those of the smallest pores be at most equal to about five.

Absolute value of the pore diameters: the maximum value of these diameters must correspond to the minimum bubbling pressure, that is to say, to the pressure of release of the gas from the electrode below which the bubbles of gas cannot escape through the pores of the electrode which open at the face of this latter opposite the other electrode, that is to say on the face of the electrode which is not covered by the porous layer. As known, the bubble pressure of a porous layer of solid material in contact with a liquid is related to the pore diameter of the layer according to the following relation (in the case where this layer has cylindrical pores perfectly regular which completely traverse this layer perpendicularly to its surface)

$$P = A \cdot \cos \theta / r$$

in which $r$ is the radius of the pores in the layer, $\theta$ is the wetting angle of the liquid on the internal walls of the pores and A is a coefficient which is a function of the surface tension of the liquid.

The minimum value of the diameter of the pores of the porous layer corresponds to the limit below which the electrolyte cannot traverse this layer at the normal operating pressure of the electrolyzer, this minimal value of the pore diameter can be calculated by giving to P in the preceding formula the value of this latter pressure.

In practice, the value of the radii of the pores of the porous layer can be between 0.10 and 10 microns.

The thickness of the porous layer can be between about 10 and 200 microns. Preferably, this thickness is however between 15 and 50 microns and, more particularly between 20 and 30 microns.

The maximum thickness of the porous layer is limited by the need to maintain the apparent specific electrical resistance of this layer, that is to say the resistance due to the obstacle that this layer represents since it only permits the passage of electrical current in streams of electrolyte which traverse its pores from one side to the other of this layer, below a limit which corresponds to the diminution of the polarization of the electrode obtained as a result of the presence of this layer.

The value of this specific apparent electrical resistance is proportional to the factor of tortuousity of the layer, that is to say, to the coefficient by which it is necessary to multiply the mean thickness of the layer to obtain the mean value of the actual length of the electrolyte streams which traverse this layer.

With regard to the porous electrode, there is utilized, for example, a plate of fritted metal, inert with respect to the electrolyte under the operating conditions of the electrolyzer, for example, a plate of iron, nickel, titanium, etc . . . or a layer of porous graphite, or further a metallic web of fine mesh (having, for example, a mesh size between 10 and 100 microns). One such electrode is known and its intrinsic conception is not part of the invention. Preferably, there is utilized an electrode having a range of pore sizes as homogeneous as possible with a mean value of the radii of these pores of between about 1 and 100 microns.

The dimensions of the pores of the porous layer of refractory oxide are preferably adapted to those of the pores of the electrode on the surface of which this layer is applied, such that the ratio between the mean radius R of the pores of this electrode and the mean radius $r$ of the pores of this porous layer is between 10 and 100.

The combination which has just been described of a porous layer of refractory oxide having the indicated characteristics and a porous electrode avoids all gas release in the lines of current of electrolysis at the time of operation of the electrolyzer which supresses the polarization effect mentioned previously, the gas release being only at the face of the electrode opposite that which faces the other electrode.

This same combination additionally permits realization of an electrolyzer according to a particularly advantageous embodiment, according to which at least one porous electrode, covered by the said porous layer of refractory oxide on at least one portion of its active surface which faces an electrode of opposite polarity, is formed in a manner to constitute at least one portion of a separation wall delimiting, from the side of its active surface covered by the refractory oxide layer, the electrolyte bath, and from the opposite side at least one compartment permitting collection of the gas product at the time of electrolysis, by discharge of ions of this electrode, the face of this latter turned towards the compartment being covered by a layer of material permeable to the gas and non-wettable by the electrolyte.

This embodiment permits gas collection, without passage of this gas through the electrolyte bath, under a pressure which can be more elevated than that which prevails in the compartment filled with the electrolyte bath. This pressure can reach several atmospheres and is produced by the simple effect of the gas release when the collector compartment is connected to an appropriate reservoir until the gas pressure reaches the bubbling pressure which corresponds to the mean radius of the pores of the porous layer of refractory oxide according to the relation $$P = A \cdot \cos \theta / r$$

where P, $\theta$, and $r$ have the definitions indicated previously.

BRIEF DESCRIPTION OF THE DRAWING

The annexed drawing shows schematically and by way of example two embodiments of the electrolyzer according to the invention.

DETAILED DESCRIPTION

Figure 1:
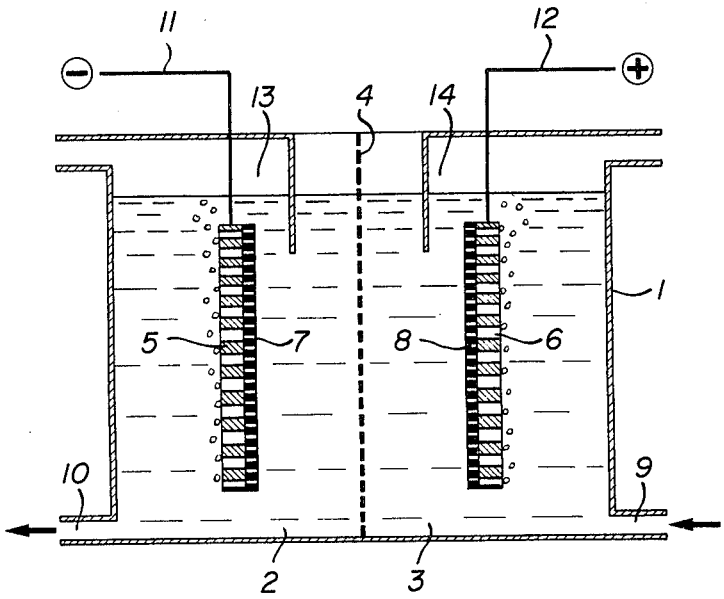
FIG. 1 is a schematic view, in section, of a first embodiment of an electrolyzer which can be utilized for the manufacture of sodium or potassium and the production of chlorine by electrolysis of an aqueous solution of sodium chloride or potassium chloride respectively.

The electrolyzer shown in FIG. 1 comprises a vessel 1 divided into a cathode-compartment 2 and an anode-compartment 3 by a porous diaphragm 4.

The interior of the vessel is filled with a liquid electrolyte bath in which are completely immersed a porous cathode 5 and a porous anode 6.

The cathode 5 and the anode 6 are constituted by rectangular plates having substantially the same dimensions, placed with their faces parallel and opposite one another.

The face of the cathode 5 turned towards the anode 6 is covered by a porous layer 7 of refractory oxide solid with the cathode 5.

Similarly, the face of the anode 6 turned towards the cathode 5 is covered by a porous layer 8 of a refractory oxide solid with the anode 6.

A conduit 9 which opens into the anode compartment 3 permits introduction of electrolyte into the electrolyzer. The electrolyte can be constituted by an aqueous solution of sodium chloride.

A conduit 10 extending from the cathode compartment 2 permits removal, in continuous or intermitent manner, of a portion of the liquid contained in this compartment. This liquid can be constituted by an aqueous solution of sodium chloride and sodium having a sodium chloride content less than that of the fresh electrolyte which is introduced into the electrolyzer through the conduit 9.

Suitable regulation means (not shown in FIG. 1) permit adjustment of the flow and/or the introduction of the electrolyte through the conduit 9 and the removal of liquid from the cathode compartment through the conduit 10 in order to obtain a suitable concentration of sodium and sodium chloride in the liquid removed from the latter conduit.

At the time of operation of the electrolyzer shown in FIG. 1 a suitable difference of potential is applied between the cathode 5 and the anode 6 by means of electrical conductors 11 and 12 respectively, these conductors being connected to an electrical energy source, not shown in the figure.

In the course of electrolysis, there is produced a gaseous release at each of the electrodes. The gas which is released at the cathode 5 can be hydrogen and that which is released at the anode 6 can be chlorine. These gaseous releases are in the form of bubbles exclusively at the external faces of the electrodes, that is to say, at the faces which are not turned towards the electrode of opposite polarity.

The gas released at the cathode 5 is collected in a collector compartment 13 and that which is released at the anode 6 is collected in a collector compartment 14.

Figure 2:
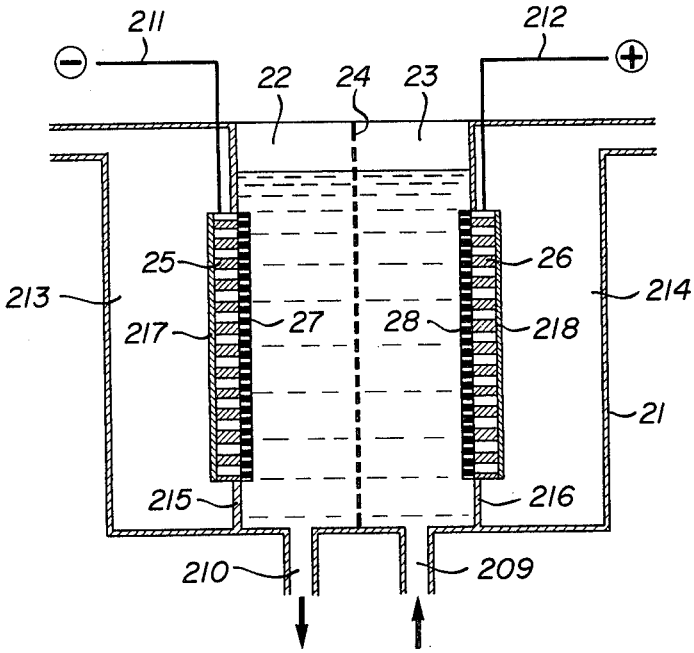
FIG. 2 is a schematic view in section of a second embodiment of an electrolyzer which can also be utilized for the production of sodium (or of potassium) and chlorine.

The electrolyzer shown in FIG. 2 comprises a vessel 21 sub-divided into a cathode compartment 22, an anode compartment 23 and two gas collector compartments 213 and 214.

The cathode and anode compartments 22 and 23 are separated from one another by a porous diaphragm 24. The cathode compartment 22 is separated from the collector compartment 213 by a liquid-tight partition 215 and the anode compartment 23 is separated from the collector compartment 214 by a liquid-tight partition 216.

A porous cathode 25 is formed as an integral portion of the partition 215. The face of the cathode 25 turned towards the compartment 22 is entirely covered by a porous layer 27 of refractory oxide solid with the cathode 25. The face of the cathode 25 turned towards the compartment 213 is completely covered by a porous layer 217 permeable to the gas, but of a material which is non-wettable by the cathode liquid (for example, polytetrafluoroethylene). The pores of the cathode 25 and of the porous layer 27 are entirely filled with cathodic liquid.

A porous anode 26 forms an integral portion of the partition 216. The face of the anode 26 turned towards the compartment 23 is entirely covered by a porous layer 28 of refractory oxide solid with the anode 26. The face of the anode 26 turned towards the compartment 214 is completely covered by a porous layer 218 permeable to the gas, but of a material non-wettable by the anodic liquid (for example, polytetrafluoroethylene). The pores of the anode 26 and of the porous layer 28 are entirely filled with anodic liquid.

A conduit 209 opens into the anode compartment 23 for feeding electrolyte into the electrolyzer, the electrolyte being an aqueous solution of sodium chloride.

A conduit 210 extends from the cathode compartment 22 for discharge of a portion of the cathode liquid (aqueous solution of sodium and of sodium chloride).

Regulating means, not shown in the figure, are also provided to adjust the rate of flow and/or the rate of introduction of the anode liquid and that of the discharge of cathode liquid through the conduit 209 and the conduit 210 respectively.

When a difference of potential suitable for the electrolysis is applied between the cathode 27 and the anode 28 through the intermediary of electrical conductors 211 and 212, hydrogen is released at the cathode 25 and chlorine is released at the anode 26.

In contrast with the case of the electrolyzer shown in FIG. 1, these gas releases are not in the form of bubbles through the cathodic and anodic liquids, but they are effected by direct passage of gas in the collector compartments 213 and 214 (hydrogen passing in the compartment 213 and chlorine in the compartment 214).

Figure 3:
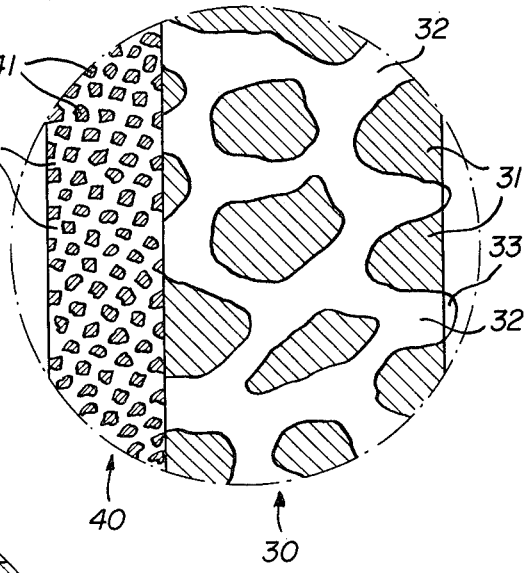
FIG. 3 is a view in section, on enlarged scale, of a portion of one of the electrodes of the electrolyzer shown in FIG. 1.

As seen in FIG. 3, the porous electrode 30 is constituted by a plurality of grains 31, of irregular shape, but of uniform size having a ratio of length to width of the order of about 2 to 3, these grains defining between one another pores 32 forming a network completely traversing the electrode. The shape of the pores 32 is also irregular but their sizes are uniform and have a ratio of length to width of about 2 to 3.

The porous layer 40 of refractory oxide is also constituted by a plurality of grains 41 between which pores 42 completely traverse the layer, the mean size of the grains 41 and the pores 42 being of an order 10 times smaller than those of the grains 31 and the pores 32 of the electrode 30.

Figure 4:
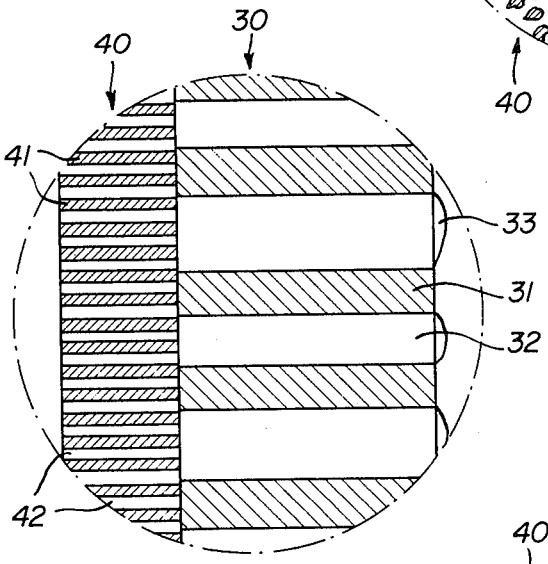
FIG. 4 is a schematic representation of the portion of the electrode shown in FIG. 3.

In FIG. 4, the pores 32 of the electrode 30 and the pores 42 of the porous layer 40 are shown, in schematic representation, in the form of tubes completely traversing, respectively, the electrode 30 and the layer 40 perpendicularly to their faces. The diameters of the pores 32 and the pores 42 shown in FIG. 4 correspond to the theoretical values calculated from the actual mean sizes of the pores 32 and 42 of the electrode 30 and of the layer 40 represented in FIG. 3.

When the pores 32 and 42 are completely filled with anodic or cathodic liquid, which is the case when the electrode 30 covering the layer 40 is immersed in one or the other of the anode or cathode compartments of the electrolyzer shown in FIG. 1, the release of gas bubbles 33 produced at the time of electrolysis at the electrode 30 can only take place at the extremities of the pores 32 open at the face of the electrode 30 which is not covered by the oxide layer 40.

In fact, the pressure $P_1$, of the gas bubbles in the layer 40 is greater than the pressure $P_2$ of the gas bubbles in the electrode 30 since the value of $P_1$ which is associated by the relation $P_1 = A \cdot \cos \theta / r$ where A and $\theta$ have the meanings indicated previously, to the mean radius $r$ of the pores 42 and the value of $P_2$ which is associated, by the relation $P_2 = A \cdot \cos \theta / R$ to the mean radius R of pores 32 are for $P_1/P_2$ at least equal to 10 since, as has been indicated previously, the ratio $R/r$ is at least 10.

Figure 5:
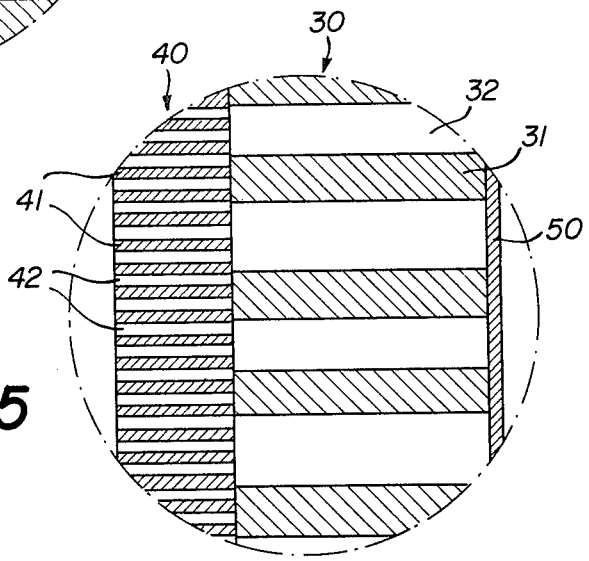
FIG. 5 is a schematic representation, on the same scale as that of FIGS. 3 and 4, of a portion of one of the electrodes of the electrolyzer shown in FIG. 2.

The portion of the electrode shown in FIG. 5 is identical to that of FIG. 4 but a layer 50 of a material permeable to the gas and non-wettable by the anodic or cathodic liquid covers the face of the electrode 30 opposite to that which is covered by the porous layer 40. Thus when the electrode 30 is disposed in the manner shown in FIG. 2, the pores 32 and 42 are entirely filled with anodic or cathodic liquid depending on whether the electrode 30 is the cathode 25 or the anode 26 of the electrolyzer, the layer 50 preventing the said liquid from flowing in the collector compartment of corresponding gas, without presenting any obstacle to the release of the gas in this compartment.

The embodiment of the electrolyzer shown in FIGS. 2 and 5 has the supplementary advantage of permitting storage of gas released at the time of electrolysis under a pressure which can be greater by several atmospheres than that prevailing in the compartment filled with electrolyte without requiring the use of a compressor. For example, if the mean radius $r$ of the pores of the layer 40 is 0.1 microns, the pressure of the gas in the gas collector compartment 213 or 214, which is equal to the bubble pressure of the gas in the layer 40, can reach a value of the order of 15 atmospheres.

Although in the preceding description, particular emphasis has been placed on the utilization of the electrolyzer according to the invention for the production of sodium and chlorine by electrolysis of an aqueous solution of sodium chloride, the advantages of the invention for the realization of an electolyzer, at least one of whose electrodes is porous and is the seat of a gas release, this electrolyzer being adapted to the production of other substances than sodium and chlorine, for example, for hydrogen by electrolysis of water, will be apparent to those skilled in the art.

On the other hand, although according to the embodiments of the electrolyzer which have been described by way of example hereinabove, the electrodes have the form of plates, it will be readily understood that the invention is not limited as regards to the shape of the electrodes. These latter can therefore have any other appropriate shape, for example, a cylindrical or tubular shape without departing from the framework of the invention.

What is claimed is:

1. An electrolyzer comprising at least one cathode and at least one anode disposed in an aqueous electrolyte bath, the electrodes each having at least one active surface directed substantially in facing relation to at least one active surface of the electrode of opposite polarity, at least one of said electrodes being permeable to the gas and being the source of a gas release at the time of operation of the electrolyzer, a distinct porous layer applied to and covering at least one portion of said active surface of said one electrode permeable to the gas, said porous layer being constituted by at least one refractory oxide which is electrically insulative and chemically inert with regard to the electrolyte and to the products formed at the time of electrolysis, at least in the range of normal operating temperature of the electrolyzer, said layer having a homogeneous distribution of pore sizes of an absolute value sufficient for the electrolyte to traverse this layer and impregnate the electrode, the mean value of the radii of the pores of the said insulating refractory oxide layer being at least as small as one-tenth of that of the pores of the electrode that it covers, said electrode and the said oxide layer cooperatively forming an element of selfsupporting structure, said oxide layer constituting a surface portion in contact with the electrolyte.

2. An electrolyzer as claimed in claim 1 wherein said one electrode constitutes at least one portion of a separation wall, separating the electrolyte bath from at least one compartment permitting collection of the gas produced at the time of electrolysis by discharge of ions from this electrode, said one electrode including on the surface thereof facing said compartment a cover layer which is permeable to the gas and is non-wettable by the electrolyte.

3. An electrolyzer as claimed in claim 1 wherein said refractory oxide is selected from the group consisting of zirconium oxide $ZrO_2$, magnesium oxide MgO, aluminum oxide $Al_2O_3$, thorium oxide $ThO_2$, titanium oxide $TiO_2$, mixtures and solid solutions of at least two of these oxides, crystallized and/or vitreous compounds having a base of at least one of these oxides, mixed oxides consisting of a definite compound formed from at least two of these oxides and mixtures of at least one such definite compound with at least one solid solution of at least two of these oxides and/or with at least one of these oxides.

4. An electrolyzer as claimed in claim 1 wherein the mean value of the radii of the pores of the said porous layer of refractory oxide is between 0.01 and 10 microns.

5. An electrolyzer as claimed in claim 1 wherein the thickness of the porous layer of refractory oxide is between 10 and 200 microns.

6. An electrolyzer as claimed in claim 1 wherein the ratio $R/r$ of the mean value of the radii R of the pores of the porous electrode and the mean value of the radii $r$ of the porous layer of refractory oxide is between 10 and 100.

7. An electrolyzer as claimed in claim 1 wherein said electrolyte is initially a solution of potassium or sodium chloride.

* * * * *

Dedication 4,086,155.—*Pierre Jonville,* Plan-Les-Ouates, Switzerland. ELECTROLYZER WITH RELEASED GAS. Patent dated Apr. 25, 1978. Dedication filed Mar. 26, 1984, by the assignee, *Battelle Memorial Institute.*

Hereby dedicates to the People of the United States the entire remaining term of said patent.

[*Official Gazette May 22, 1984.*]